United States Patent [19]

Nakahata et al.

[11] Patent Number: 4,641,948

[45] Date of Patent: Feb. 10, 1987

[54] METHOD OF AND DEVICE FOR PREVENTING DISTURBANCE OF UNFIXED VISIBLE IMAGE

[75] Inventors: Kimio Nakahata, Kawasaki; Tsutomu Toyono, Tokyo; Atsushi Takagi, Fujisawa; Yoshinori Aguro, Fuchu, all of Japan

[73] Assignee: Canon Kabushiki Kaisha, Tokyo, Japan

[21] Appl. No.: 8,952

[22] Filed: Feb. 2, 1979

Related U.S. Application Data

[63] Continuation of Ser. No. 784,816, Apr. 5, 1977, abandoned.

[30] Foreign Application Priority Data

Apr. 13, 1976 [JP] Japan ..... 51-41661

[51] Int. Cl.[4] ..... G03G 21/00

[52] U.S. Cl. ..... 355/3 SH; 271/307; 355/3 TR; 361/213

[58] Field of Search ..... 355/3 R, 3 TR, 3 SH, 355/14 SH, 14 TR; 361/213, 214; 271/307, 308, 311, 312, DIG. 2

[56] References Cited

U.S. PATENT DOCUMENTS 1,208,238 12/1916 Tooker et al. ..... 361/214
3,508,824 4/1970 Leinbach et al. .
3,620,615 11/1971 Volkers ..... 271/DIG. 2 X
3,684,363 8/1972 Ito et al. ..... 355/3 R
3,769,695 11/1973 Price et al. ..... 361/213 X
4,014,538 3/1977 Akiyama et al. ..... 271/DIG. 2 X
4,055,380 10/1977 Borostyan ..... 355/3 TR
4,062,631 12/1977 Ichikawa et al. ..... 271/308 X

FOREIGN PATENT DOCUMENTS 2637261 3/1977 Fed. Rep. of Germany ..... 271/308

*Primary Examiner*—Fred L. Braun
*Attorney, Agent, or Firm*—Fitzpatrick, Cella, Harper & Scinto

[57] ABSTRACT

In a method of or a device for preventing disturbance of an unfixed image in an image formation process wherein an electrostatic image on an electrostatic image bearing member is developed by a developer, whereafter the developed visible image is transferred to a transfer medium and then the transfer medium is separated from the electrostatic image bearing member and conveyed for utilization, charge remover is provided along the conveyance path of the transfer medium to remove the charge on the surface of the transfer medium as it passes through the conveyance path, thereby preventing the visible image on the transfer medium from being disturbed.

19 Claims, 9 Drawing Figures

METHOD OF AND DEVICE FOR PREVENTING DISTURBANCE OF UNFIXED VISIBLE IMAGE

This is a continuation of application Ser. No. 784,816, filed Apr. 5, 1977, now abandoned.

BACKGROUND OF THE INVENTION a. Field of the Invention

This invention relates to a method of and a device for enabling an image bearing member such as transfer medium or the like to be conveyed without disturbing an unfixed visible image electrostatically retained thereon in an image formation apparatus such as electrophotographic apparatus or electrostatic recording apparatus.

b. Description of the Prior Art

Generally, in an image formation apparatus such as electrophotographic apparatus or electrostatic recording apparatus, image formation is accomplished by developing an electrostatic image into a visible image. Where electrophotography is used, a photosensitive medium having a photoconductive layer is employed as an electrostatic image bearing member. Such photosensitive medium, i.e. electrostatic image bearing member, is subjected to charging by a corona discharger or the like and if required, voltage application for removal of the charge, exposure to light information, etc., thereby forming an electrostatic latent image. Such electrostatic latent image is developed into a visible image while being retained on that electrostatic image bearing member or after having been transferred to another electrostatic image bearing member. The image development is effected either by the dry type developing technique using dry particulate developer or by the wet type developing technique using developer particles diffused in a carrier liquid. The visible image so formed on the electrostatic image bearing member is transferred to a transfer medium such as plain paper superposed on the image bearing member, by applying a voltage to the back side of the transfer medium from a voltage applying means such as corona discharger or roller electrode. The transfer medium, after having the visible image transferred thereto, is separated from the electrostatic image bearing member and conveyed to fixing means including heaters and heating rollers for fixing the visible image, whereby the visible image is fixed. Since the visible image on the transfer medium so separated and conveyed to the fixing means is in its unfixed state, it is necessary to protect the unfixed visible image against disturbance during the conveyance of the transfer medium. However, with an image formation apparatus, for example, an electrophotographic copying apparatus which tends to be of a reduced size and is a complicated mechanism, it is often the case that the conveyance path of the transfer medium is unavoidably formed with a bend. If the unfixed transfer medium is conveyed along a conveyance path having such a bend, the visible image thereon may sometimes be disturbed, thus failing to provide a good copy image. The reason why such phenomenon of disturbance occurs to the visible image may be appreciated from the following:

First, in the step of transferring a visible image from an electrostatic image bearing member to a transfer medium, it is usually the practice that charge of the opposite polarity to the developer is uniformly applied to the back side of the transfer medium from a corona discharger or the like. By this, charge of the opposite polarity to the charge from the image transfer corona discharger is induced in the electrostatic image bearing member and as a result, the transfer medium is electrostatically attracted into intimate contact with the electrostatic image bearing member. The electric field then produced by the corresponding charge induced by the charge on the transfer medium is sufficiently stronger than the electric field produced by the corresponding charge of the electrostatic image on the electrostatic image bearing member, so that the particles of the developer move to the transfer medium to thereby complete the image transfer. Then, the transfer medium is forcibly separated from the electrostatic attraction to the electrostatic image bearing member by a separating means such as separating belt and separating pawl. Once separated, the transfer medium has charged, unfixed developer particles on one surface thereof and has, on the other surface, a charge of the opposite polarity to the developer imparted during the image transfer step. Therefore, if the transfer medium being conveyed is abruptly bent, the bent portion thereof will experience a sharp variation in electric field which will result in disturbance of the visible image due to the unfixed developer on the transfer medium. Usually, such disturbance of the visible image appears in the form of a circular series of spots in which the developing density is reduced. Such disturbance resulting in a reduced developing density renders illegible the reproduced image such as characters or the like, and would especially result in a quite undesirable copy image if the image to be reproduced is a tone image such as a photograph or the like.

The above-noted phenomenon becomes pronounced when the specific resistivity of the transfer medium itself is higher. For example, where the transfer medium used is plain paper having its specific resistivity increased to $10^{12}$ Ω-cm or more under the influence of the environmental humidity and other factors, or where the transfer medium used is formed of insulative resin such as polyester film or the like, the disturbance of the visible image is conspicuous.

This would be attributable to the following reason. Where the transfer medium is of a low specific resistivity, the charge retained by the developer particles deposited on the surface thereof is liable to be neutralized by the charge imparted by the voltage application during the image transfer, but if the resistivity becomes higher, there will occur no sufficient movement of the charge to neutralize the charge of the developer particles. Thus, for a transfer medium of high specific resistivity, conveyance will take place with charge retained by the developer particles on the surface thereof. If such a transfer medium is deformed by a bend of the conveyance route, the electric field formed by the surface charge of the transfer medium will be sharply varied so that the developer particles will be scattered away under the influence of that variation in electric field.

These problems may be overcome by the present invention.

SUMMARY OF THE INVENTION

It is an object of the present invention to provide a method which enables an image bearing member such as transfer medium to be conveyed without disturbing the visible image electrostatically retained thereon.

It is another object of the present invention to provide a device which enables an image bearing member such as transfer medium to be conveyed without disturbing the visible image electrostatically retained thereon.

Other objects of the present invention will become fully apparent to those skilled in the art from the following detailed description of some specific embodiments of the invention.

Generally described, the present invention removes charge from a transfer medium to which a visible image has been transferred for utilization after an electrostatic image on an electrostatic image bearing member has been developed by means of developer.

Further, in the device of the present invention, a grounded electrode or electrodes are disposed adjacent to the path of transfer medium to remove any charge remaining on the transfer medium.

The term "electrostatic image bearing member" herein used is not restricted to a photosensitive medium having a photoconductive layer but includes insulative mediums capable of retaining charge thereon and may take any of various shapes such as drum, web and other shapes.

The electrostatic image formed on such electrostatic image bearing member may not only be one directly formed thereon in accordance with the electrophotographic system, but may be based on the latent image transfer system wherein an electrostatic image formed on one electrostatic image bearing member is transferred to another medium, or the electrode system wherein an object is formed into an image by the use of an electrode, or the ion flow modulation system wherein ion flows are modulated to form an image.

DESCRIPTION OF THE PREFERRED EMBODIMENTS

Figure 1:
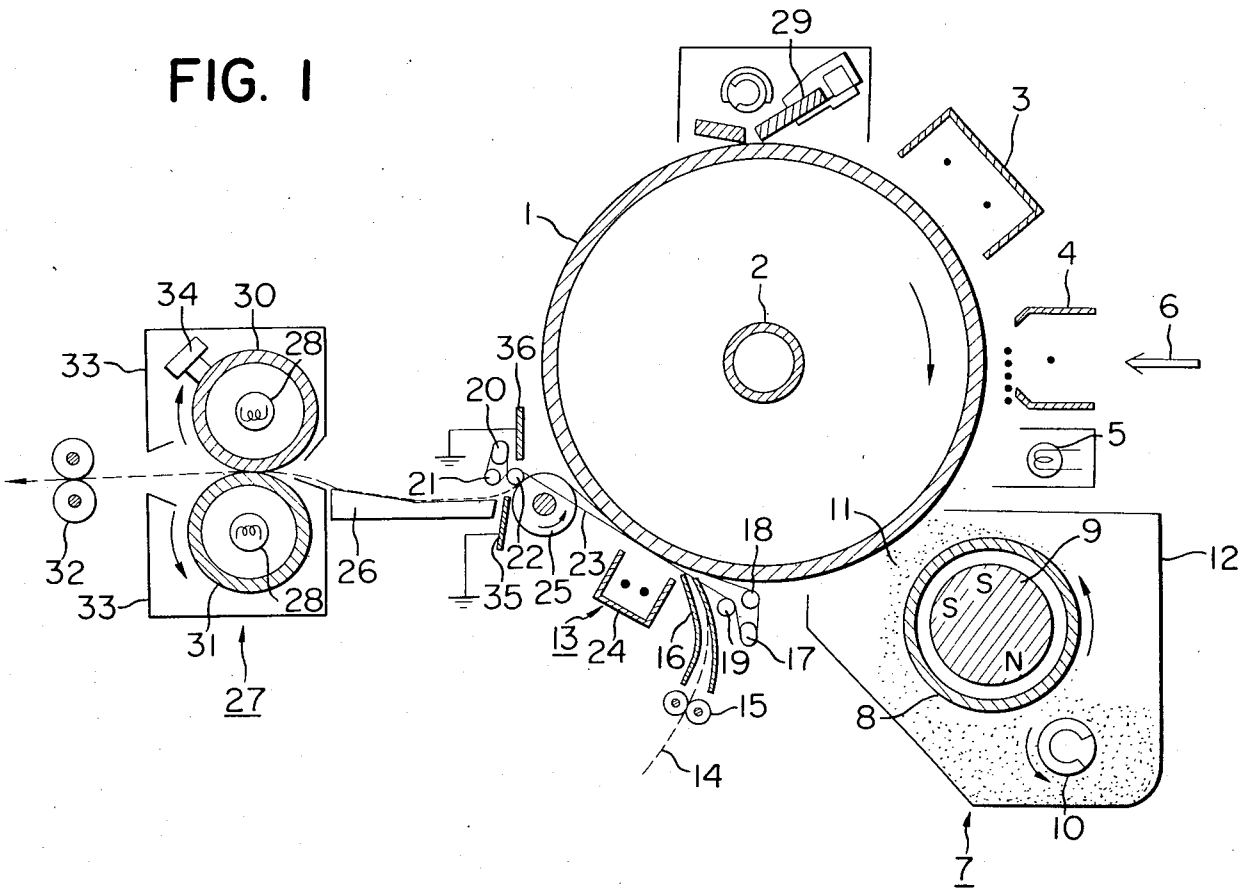
FIG. 1 is a cross-sectional view of the essential portions of an electrophotographic copying apparatus to which the present invention is applied.

Referring to FIG. 1, it shows, in cross-section, the major portions of an electrophotographic copying apparatus to which the present invention is applied. In the shown electrophotographic copying apparatus, a drum-shaped photosensitive medium 1 is used as an electrostatic image bearing member and various process means are arranged around the photosensitive medium 1. The material and construction of such photosensitive medium and the process applied thereto are disclosed in our U.S. Pat. No. 3,734,609 (DOLS 1,522,567), U.S. Pat. Nos. 3,666,363–3,666,365 (DOLS 1,522,568), etc. The photosensitive medium 1 may be provided by forming a drum of aluminum alloy serving also as a conductive layer, and laying a photoconductive layer and an insulative surface layer over the conductive layer. The photosensitive medium 1 comprising these three layers is rotatable in the direction of the arrow. The process for forming electrostatic images on the photosensitive medium 1 may be the one disclosed in any of the above-mentioned patents. That is, the photosensitive medium 1 begins to rotate in the direction of the arrow when the operation for the formation of a copy image is started. The photosensitive medium is uniformly charged, for example, to the positive (+) polarity by a first corona discharger 3, and then subjected to AC corona discharge of opposite, i.e. negative (−) corona discharge, by a second corona discharger 4 while being exposed to an image original. The photosensitive medium 1 is further subjected to a whole surface exposure by a whole surface exposure lamp 5, whereby a latent image having a high electrostatic contrast is formed on the photosensitive medium. It will b noted that the exposure to the image original is accomplished by illuminating an image original on a transparent glass plate with a lamp and directing the reflected light resulting from the illumination through an optical system (not shown), including a mirror lens system or the like, to the above-mentioned discharger 4 having an optically opened back side. Alternatively, the exposure may be accomplished by using a microfilm or the like as an image original and causing a light to be transmitted therethrough. Arrow 6 designates the image of the original directed to the discharger 4 through the optical system.

The electrostatic latent image on the photosensitive medium 1 corresponding to the image of the original is thereafter developed by a developing device 7 with the aid of a particulate developer such as toner or the like. The developing device 7 has a fixed magnet 9 within a rotatable non-magnetic cylinder member 8 and effects development with the developer being circulated in the direction of arrow by the rotation of the cylinder member 8 with the aid of the cooperation of the carrier in the developer. The developing device 7 includes a stirring member 10 for developer, a developing electrode 11 having magnetic poles for causing the developer to form a brush which may make soft contact with the latent image to thereby effect development, and a casing 12 for the developing device 7.

At a transfer station 13, the visualized image provided on the photosensitive medium by the above-described development is transferred onto a transfer medium conveyed in synchronism with the visualized image. The transfer medium is conveyed in the direction of dot-and-dash line 14 from a transfer medium container unit, not shown. The transfer medium, so conveyed, is directed toward the photosensitive medium 1 by conveyor rollers 15 and through guide plates 16. One side edge of the transfer medium is then brought into contact with the photosensitive medium 1 through a separating belt 23 passed over pulleys 17–22, and voltage application is imparted to the transfer medium from its back side by corona discharge from an image transfer corona discharger 24. In the apparatus described above, a latent image corresponding to the dark region of the image original is formed by positive charges and therefore, the developer in use must be one charged to the negative polarity and the image transfer corona discharger 24 effects corona discharge of the positive polarity for drawing the visualized image toward the transfer medium. The transfer medium, to which the visualized image has been so transferred, is forcibly separated from the photosensitive medium 1 by the separating belt 23, whereafter it is conveyed along a greatly bent path and onto an insulatively surfaced guide plate 26 by an insulatively surfaced roller 25 disposed parallel to the rotary shaft 2 of the photosensitve medium 1. The guide plate 26 may comprise a plurality of metal plates coated with insulative paint or a plurality of resin plates arranged parallel to one another.

As a charge removing means for transfer medium, there are disposed grounded electrodes 35 and 36 along the portion of the transfer medium path between the roller 25 and the guide plate 26. As will be described below in detail, these grounded electrodes serve to remove the charge from the surface of the transfer medium. This leads to the elimination of the fear that the visible image on the transfer medium should be disturbed.

After the image transfer has been so completed, the transfer medium passes over the roller 25 and the guide plate 26 to a fixing device 27. The fixing device 27 comprises a pair of heat rollers 30 and 31 each having a heater 28 therewithin. As the transfer medium passes between these heat rollers 30 and 31, the developer on the transfer medium is fused and fixed thereon. After the fixation has been finished, the transfer medium is discharged outwardly of the apparatus by a pair of conveyor rollers 32. Designated by 33 is a casing for the fixing device 27, and 34 a temperature detecting element for the heat rollers. After the image transfer, the photosensitive medium is cleaned by a cleaning member 29 to remove any residual developer remaining thereon, thus becoming ready for another cycle of image formation.

The charge removing means for transfer medium according to the present invention will now be described in detail. In the illustrated apparatus as already mentioned, the grounded electrodes provided as the charge removing means along the portion of the transfer medium path adjacent to the roller 25 effects the removal of charge from the transfer medium so as to alleviate the sharp variation in the electric field resulting from the flexure of the transfer medium which occurs when the transfer medium greatly deflected by the roller 25 is passing to the guide plate 26. A specific and effective means for such purpose is shown, for example, in FIG. 2(A), wherein a grounded electrode comprises a so-called barbed conductor provided with angled discharging tips. Such an electrode is disposed as the electrode 36 with respect to the image bearing surface of the transfer medium adjacent to the bent portion of the path whereat the transfer medium is deflected, and a similar electrode is disposed as the electrode 35 with respect to the back side of the transfer medium.

Figure 2A:
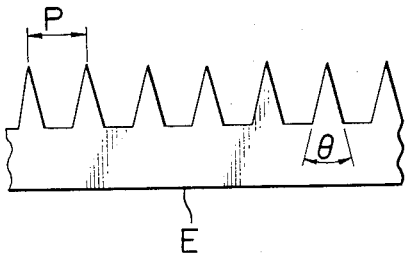
FIG. 2(A) is a fragmentary front view showing a form of the electrode according to an embodiment of the present invention.

The transfer medium, when separated from the photosensitive medium 1, retains thereon a potential of several thousand to several tens of thousand volts as it passes over the insulative roller 25 to the bent portion of the path, so that the transfer medium readily creates self-discharbe between itself and the grounded electrodes 35, 36 to thereby reduce the charge possessed by the transfer medium and accordingly the electric field, and this prevents the unfixed visible image on the transfer medium from being disturbed by the sharp variation in the electric field. The construction of the above-described grounded electrodes will further be considered hereinafter.

Where the toothed conductor as shown in FIG. 2(A) is employed as a grounded electrode, it has been found that a good result may be obtained if it is formed of a stainless metal having a thickness of about 0.1 to 0.2 mm with a pitch P of 2 to 15 mm, the tip angle $\theta$ of each toothed portion being selected in a range below 110°.

Here is further shown the result of the experiments carried out to ascertain such conditions of the electrode pitch and tip angle.

Figure 3:
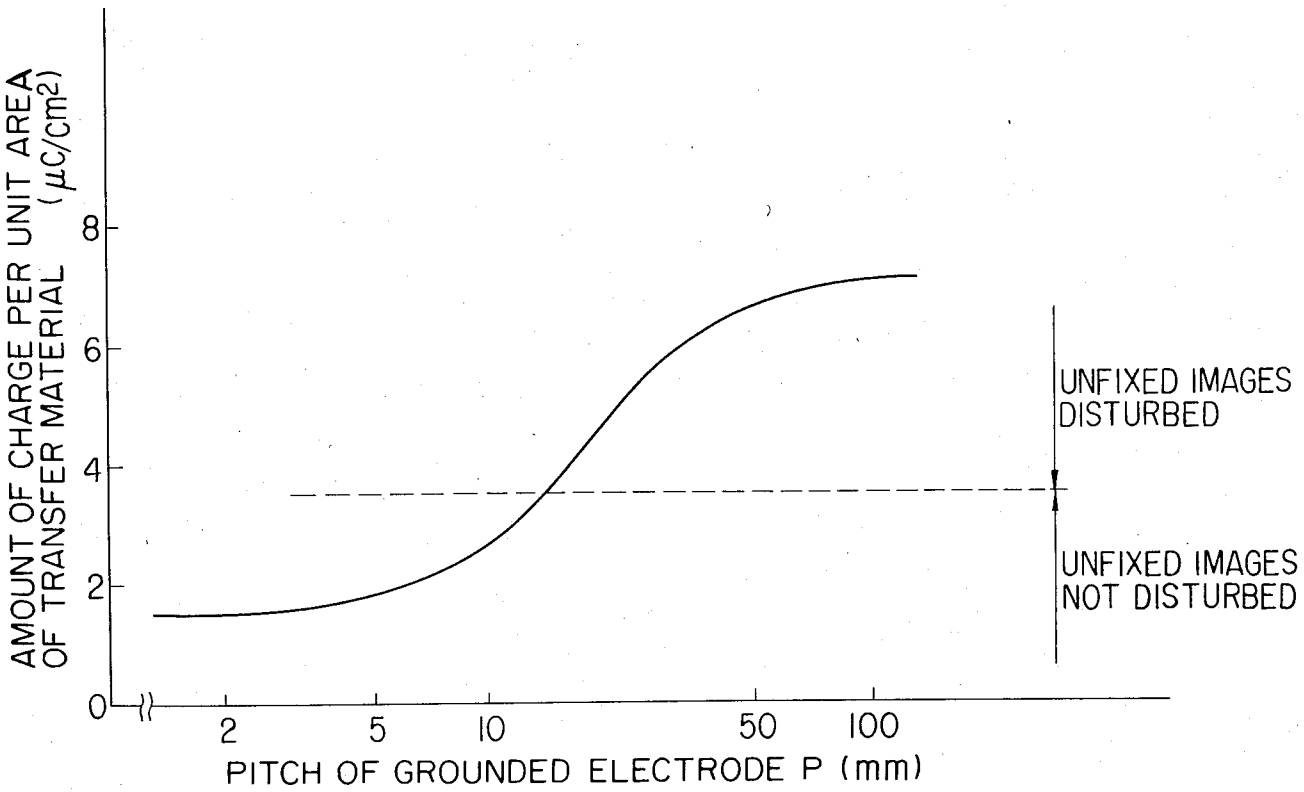
FIG. 3 is a graph illustrating the relation between the pitch of the grounded electrode and the amount of charge per unit area of the transfer medium.

FIG. 3 graphically illustrates the relation between the variation in pitch of the grounded electrode and the corresponding variation in surface charge of the transfer medium.

The electrode used in the experiments was formed of a stainless metal having a thickness of 0.2 mm and a tip angle $\theta$ selected at 30°, and was displaced with respect to the back side of the transfer medium, as previously mentioned. The transfer medium used was plain paper having a resistance value of $3.2\times10^{13}$ Ω-cm. The environment in which the experiment was carried out was at a room temperature of 20° C. and at a room humidity of 30%.

In the graph of FIG. 3, the ordinate represents the amount of charge per unit area of the transfer medium ($\mu C/cm^2$) and the abscissa represents the pitch length of the electrode (mm).

The broken line crossed by the correlated curve of the electrode pitch and the amount of surface charge represents the amount of charge which is approximately $\mu C/cm^2$, and this broken line indicates a boundary defining an area in which an unfixed image is disturbed if the amount of charge exceeds the boundary.

As will be appreciated from FIG. 3, it is possible to successfully prevent disturbance of an unfixed image by setting the electrode pitch at 15 mm or less.

Figure 4:
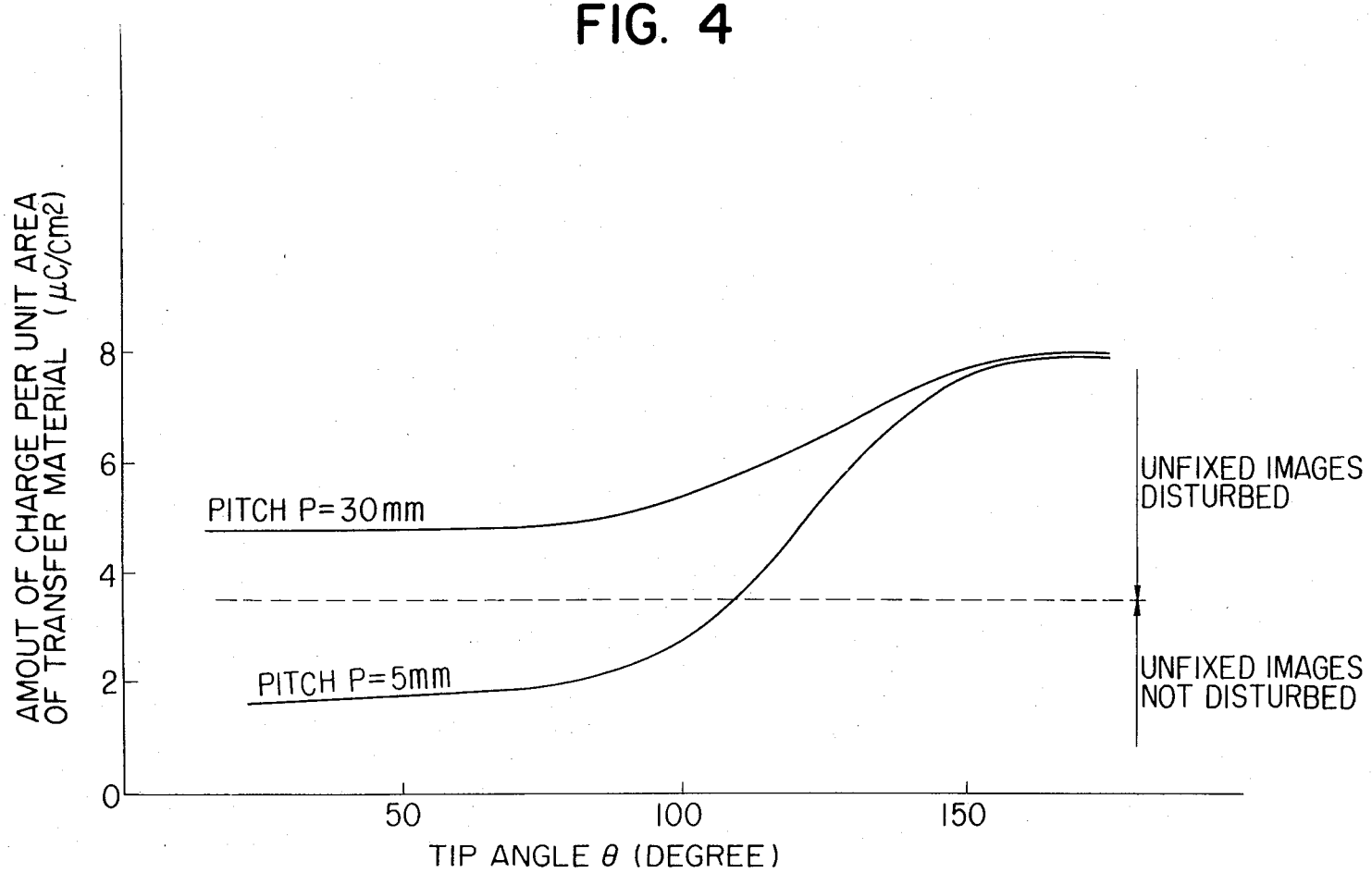
FIG. 4 is a graph illustrating the relation between the tip angle $\theta$ of the grounded electrode and the amount of charge per unit area of the transfer medium.

FIG. 4 is a graph illustrating the relation between the tip angle $\theta$ of the electrode and the amount of charge per unit area of the transfer medium.

In the experiments, use was made of two electrodes formed of stainless metal having a thickness of 0.2 mm and a pitch P of 5 mm and 30 mm, respectively. The other conditions such as the conditions of the transfer medium and the environment were similar to those in the case of FIG. 3.

In the graph of FIG. 4, the ordinate represents the amount of charge per unit area of the transfer medium ($\mu C/cm^2$) and the abscissa represents the tip angle $\theta$ (degrees).

As in the case of FIG. 3, the boundary value at which disturbance occurs to an unfixed image is substantially in the vicinity of 3.5 $\mu C/cm^2$ and it will therefore be apparent that if the pitch P is 5 mm and the tip angle $\theta$ is set at about 110° or less, disturbance of the unfixed visible image may be prevented.

As will be appreciated from the above-described experimental construction, a grounded electrode designed to cause harmful charge in the transfer medium to quickly self-discharge after the image transfer is highly effective as a charge removing means.

Figure 5A:
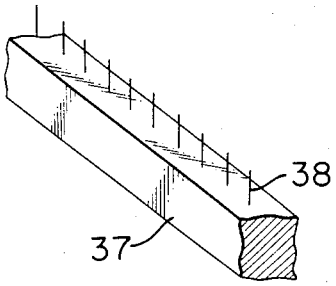
FIGS. 5(A) and (B) are fragmentary perspective views showing further forms of the electrode according to the present invention.
Figure 2B:
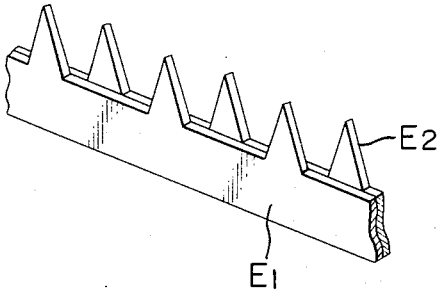
FIGS. 2(B) and (C) are perspective views showing modified arrangements of the electrode.
Figure 5B:
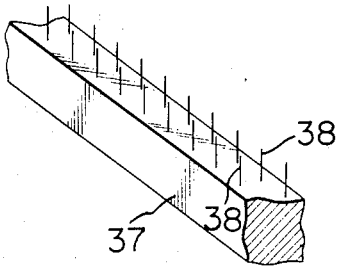
Figure 2C:
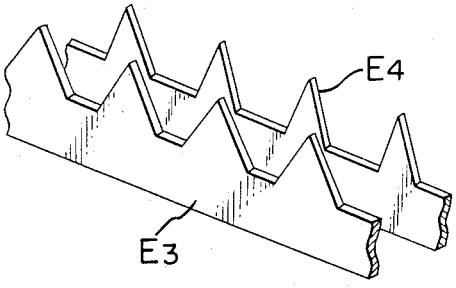

The construction of such an electrode is not restricted to the form as shown in FIG. 2(A) wherein a single plate-like electrode provided with toothed portions is used, but as shown in FIG. 2(B), a plurality of plate-like electrodes $E_1$ and $E_2$ each being toothed at a long pitch and overlapped with each other would also be effective to prevent disturbance of the unfixed image. As a further alternative, it would also be effective to arrange a plurality of plate-like electrodes different in discharging efficiency in overlapped relationship or with a clearance maintained therebetween. Such an arrangement is shown, for example, in FIG. 2(C), wherein an electrode $E_3$ provided at the entrance side of the transfer medium advancing in the direction of arrow has a tip angle of about 110° for each toothed portion thereof and a subsequent electrode $E_4$ has a tip angle of about 50° for each toothed portion thereof, whereby sharp discharge from the surface of the transfer medium may be avoided to thereby evade the variation in electric field which would otherwise result from the sharp discharge. As a further alternative, these electrodes may differ only in the pitch of the teeth, or both in pitch and tip angle. Instead of the plate-like forms of the electrode as shown in FIG. 2, an electrode construction as shown in FIG. 5(A) wherein conductive thin metal wires 38 are studded in a row on a conductive base member 37 would also be effective. The conductive thin wires 38 may also be arranged alternately in two rows as shown in FIG. 5(B). By suitably selecting the material and diameter of the thin wires (the diameter to the order of 100 $\mu$) so as to provide a good flexibility, such thin wires would never prevent the advance of the transfer medium even if the latter come into contact with the wires during its conveyance, thus eliminating the unfavorable possibility that the direction of movement of the transfer medium is deflected or deviated which might in turn lead to jam or other accidents.

Figure 6:
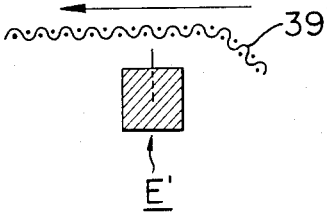
FIG. 6 is a fragmentary side view showing an arrangement of the electrode.

FIG. 6 illustrates an example of the electrode arrangement, in which a screen-like insulative guide member is provided between a grounded electrode E' and a transfer medium moving in the direction of arrow. Such provision of the guide member is preferable to maintain a constant clearance between the transfer medium and the electrode and ensure uniform discharge.

It is also preferable that other guide members provided along the conveyance path preceding the discharging electrodes be made insulative in at least the portion thereof contacted by the transfer medium. If the portion of the guide members contacted by the transfer medium were conductive, the charge on the transfer medium would be abruptly varied to cause displacement of the developer existing in the area of the image which is adjacent to the contacted portion, and this would in turn cause variation in the developing density in such area to a great inconvenience.

The above-described electrode may of course be disposed at both or only one side, either the side which faces the image bearing surface of the transfer medium or the side which faces the back surface of the transfer medium. In either case, it is essential that the position or positions for effectively removing the charge on the surface of the transfer medium be chosen in accordance with the conveyance path in the apparatus.

The present invention, as already described in detail with respect to some specific embodiments, can remove the charge on the transfer medium and can thus prevent the unfixed visible image thereon from being disturbed during the conveyance of the transfer medium.

The present invention ensures the transfer medium to be conveyed within an image formation apparatus having a sinuous path for conveyance of transfer medium without the unfixed visible image on the transfer medium being disturbed, and this is effective for good image reproduction.

The device according to the present invention can be effectively put into practice with a very simple construction and without requiring a great space. In addition, the device of the present invention eliminates the necessity of making direct contact with the transfer medium, thus eliminating the possibility of interfering with the conveyance of the transfer medium and accordingly, the fear of jam or other accidents.

What we claim is:

1. A method of preventing disturbance of an unfixed visible image in an image formation process wherein an electrostatic image on an electrostatic image bearing member is developed into a visible image with a developer, thereafter the developed visible image is electrostatically transferred to a transfer medium in contact therewith at a transfer station and then the transfer medium is mechanically separated from and conveyed away from the image bearing member, said method comprising the steps of disposing charge removing means having a plurality of distinct discharging portions so that the plurality of distinct discharging portions are adjacent to but spaced from the transfer medium as the transfer medium is conveyed away from the image bearing member and past the charge removing means, and maintaining the plurality of district discharging portions at a potential such that an electric field is created across the space between the transfer medium and the plurality of distinct discharging portions to electrically discharge the transfer medium and thereby prevent disturbance of the unfixed image on the transfer medium.

2. A method according to claim 1, wherein said charge removing means includes a grounded electrode so that the charge on the surface of the transfer medium is discharged to said electrode.

3. A method according to claim 2, wherein said electrode has a toothed portion in which pointed tooth-like projections are arranged at predetermined intervals.

4. A method according to claim 2, wherein said electrode has thin wires arranged thereon at predetermined intervals.

5. A device for preventing disturbance of an unfixed visible image in an image formation apparatus wherein an electrostatic image on an electrostatic image bearing member is developed into a visible image with a developer, thereafter the developed visible image is electrostatically transferred to a transfer medium in contact therewith at a transfer station and then the transfer medium is mechanically separated from and conveyed away from the image bearing member, said device comprising:

charge removing means having a plurality of distinct discharging portions which portions are disposed adjacent to but spaced from the transfer medium as the transfer medium is conveyed away from the image bearing member and past the charge removing means; and means for maintaining said plurality of distinct discharging portions at a potential such as to create an electric field across the space between the transfer medium and said plurality of distinct discharging portions to electrically discharge the transfer medium and thereby prevent disturbance of the unfixed image on the transfer medium.

6. A device according to claim 5, wherein said charge removing means includes a grounded electrode.

7. A device according to claim 6, wherein said electrode of said charge removing means includes a plurality of discharging portions having a predetermined pitch.

8. A device according to claim 7, wherein said plurality of discharging portions of said electrode are each tooth shaped.

9. A device according to claim 7, wherein said plurality of discharging portions of said electrode are each a thin wire.

10. A device according to claim 7, wherein the pitch of each of said plurality of discharging portions of said electrode is 15 mm or less.

11. A device according to claim 8, wherein the tip angle of each of said plurality of discharging portions of said electrode is 110° or less.

12. A device according to claim 5, wherein said charge removing means includes a plurality of grounded electrodes.

13. A device according to claim 5, further comprising a guide member provided between said charge removing means and the transfer medium.

14. A device according to claim 13, wherein said guide member is in a screen-like form.

15. A device according to claim 13, wherein said guide member is insulative.

16. A device according to claim 12, wherein said plurality of grounded electrodes are disposed adjacent to the transfer medium.

17. A device according to claim 12, wherein said plurality of grounded electrodes are disposed such that the transfer medium is conveyed therebetween.

18. A device according to claim 12, wherein the discharging portions of said plurality of electrodes have different contours, respectively.

19. A device according to claim 12, wherein each of said plurality of grounded electrodes includes a plurality of discharging portions having a predetermined pitch.

* * * * *